US007186306B2

(12) United States Patent
Branagan

(10) Patent No.: US 7,186,306 B2
(45) Date of Patent: Mar. 6, 2007

(54) METHOD OF MODIFYING IRON BASED GLASSES TO INCREASE CRYSTALLIZATION TEMPERATURE WITHOUT CHANGING MELTING TEMPERATURE

(75) Inventor: Daniel James Branagan, Idaho Falls, ID (US)

(73) Assignee: The Nanosteel Company, Providence, RI (US)

( * ) Notice: Subject to any disclaimer, the term of this patent is extended or adjusted under 35 U.S.C. 154(b) by 1 day.

(21) Appl. No.: 10/779,459

(22) Filed: Feb. 13, 2004

(65) Prior Publication Data

US 2004/0250929 A1 Dec. 16, 2004

Related U.S. Application Data

(60) Provisional application No. 60/447,398, filed on Feb. 14, 2003.

(51) Int. Cl.
*C22C 45/02* (2006.01)

(52) U.S. Cl. ..... 148/403; 148/304

(58) Field of Classification Search ..... 148/304, 148/403

See application file for complete search history.

(56) References Cited

U.S. PATENT DOCUMENTS 4,409,043 A * 10/1983 Koon ..... 148/403
4,437,912 A 3/1984 Sakakima et al. ..... 148/403
4,581,081 A * 4/1986 Kroeger et al. ..... 148/403
4,668,310 A 5/1987 Kudo et al. ..... 148/304
5,660,929 A 8/1997 Suzuki et al. ..... 428/332

FOREIGN PATENT DOCUMENTS

JP 357051237 A 3/1982
JP 357185949 A 11/1982

OTHER PUBLICATIONS

International Search Report for corresponding PCT application PCT/US04/04510 (6 pgs).
Written Opinion for corresponding PCT application PCT/US04/04510 (3 pgs).

* cited by examiner

*Primary Examiner*—George Wyszomierski
(74) *Attorney, Agent, or Firm*—Grossman Tucker Perreault & Pfleger, PLLC

(57) ABSTRACT

An alloy design approach to modify and improve existing iron based glasses. The modification is related to increasing the stability of the glass, which results in increased crystallization temperature, and increasing the reduced crystallization temperature ($T_{crystallization}/T_{melting}$), which leads to a reduced critical cooling rate for metallic glass formation. The modification to the iron alloys includes the additional of lanthanide elements, including gadolinium.

5 Claims, 1 Drawing Sheet

DTA plots showing the glass to crystalline transition for the ALLOY A and the Gd modified GALLOY A alloys.

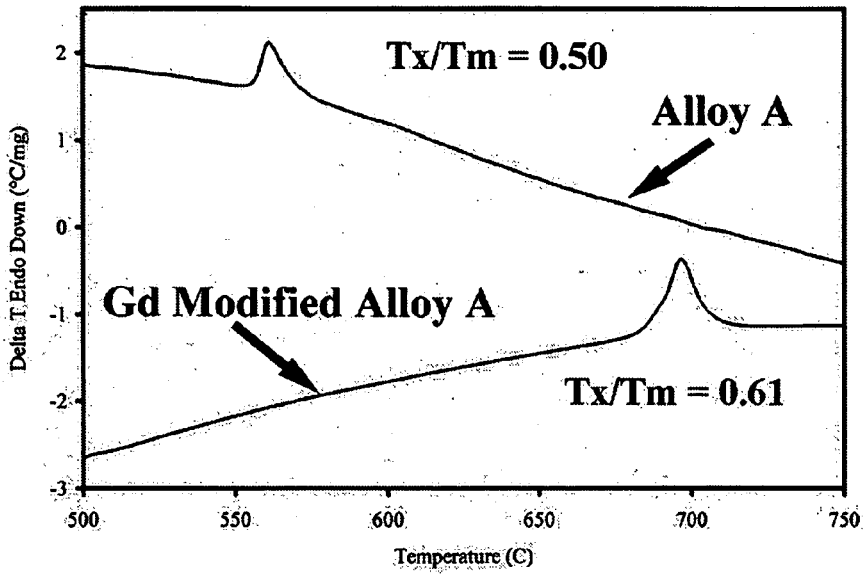
Figure 1 DTA plots showing the glass to crystalline transition for the ALLOY A and the Gd modified GALLOY A alloys.
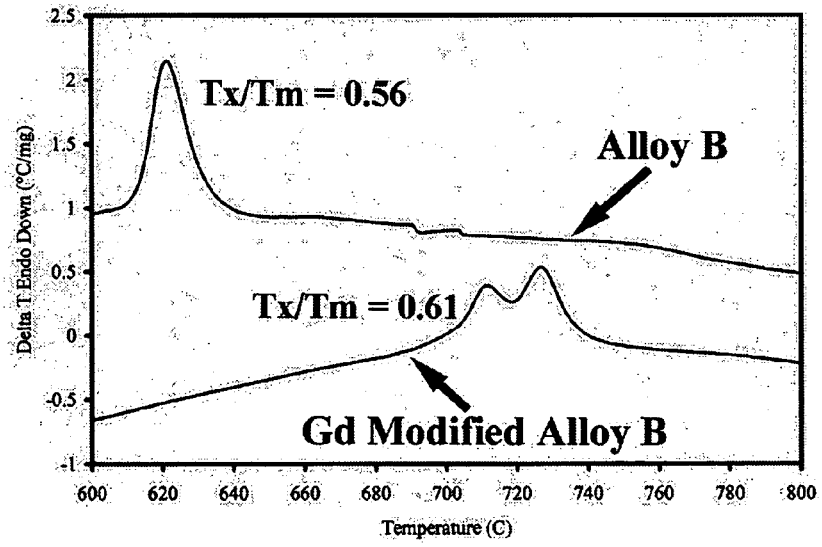
Figure 2 DTA plots showing the glass to crystalline transition for the ALLOY B and the Gd modified GALLOY B alloys.

METHOD OF MODIFYING IRON BASED GLASSES TO INCREASE CRYSTALLIZATION TEMPERATURE WITHOUT CHANGING MELTING TEMPERATURE

CROSS REFERENCE TO RELATED APPLICATIONS

This application claims priority to U.S. Provisional Application No. 60/447,398 filed Feb. 14, 2003.

FIELD OF INVENTION

The present invention relates generally to metallic glasses, and more particularly to a method of increasing crystallization temperature, while minimally affecting melting temperature. The resultant glass has a reduced critical cooling rate which allows the formation of the glass structure by a larger number of standard industrial processing techniques, thereby enhancing the functionality of the metallic glass.

BACKGROUND

It has been known for at least 30 years, since the discovery of Metglasses (iron based glass forming compositions used for transformer core applications) that iron based alloys could be made to be metallic glasses. However, with few exceptions, these iron based glassy alloys have had very poor glass forming ability and the amorphous state could only be produced at very high cooling rates (>$10^6$ K/s). Thus, these alloys can only be processed by techniques which give very rapid cooling such as drop impact or melt-spinning techniques.

All metal glasses are metastable and given enough activation energy they will transform into a crystalline state. The kinetics of the transformation of a metallic glass to a crystalline material is governed by both temperature and time. In conventional TTT (Time-Temperature-Transformation) plots, the transformation often exhibits C-curve kinetics. At the peak transformation temperature, the devitrification (transformation from an amorphous glass to a crystalline structure) is extremely rapid, but as the temperature is reduced the devitrification occurs at an increasingly slower rate. When the crystallization temperature of the metallic glass is increased, the TTT curve is effectively shifted up (to higher temperature). Accordingly, any given temperature will be lower on the TTT curve indicating a longer devitrification rate and, therefore, a more stable metal glass structure. These changes manifest as an increase in the available operating temperature and a dramatic lengthening of stable time at any particular temperature before crystallization is initiated. The result of increasing the crystallization temperature is an increase in the utility of the metal glass for a given, elevated service temperature.

Increasing the crystallization temperature of a metal glass may increase the range of suitable applications for metal glass. Higher crystallization temperatures may allow the glass to be used in elevated temperature environments, such as under the hood applications in automobiles, advanced military engines, or industrial power plants. Additionally, higher crystallization temperatures may increase the likelihood that a glass will not crystallize even after extended periods of time in environments where the temperature is below the metal glass's crystallization temperature. This may be especially important for applications such as storage of nuclear waste at low temperature, but for extremely long periods of time, perhaps for thousands of years.

Similarly, increasing the stability of the glass may allow thicker deposits of glass to be produced and may also enable the use of more efficient, effective, and diverse industrial processing methods. For example, when an alloy melt is spray formed, the deposit which is formed undergoes two distinct cooling regimes. The atomized spray cools very quickly, in the range of $10^4$ to $10^5$ K/s, which facilitates the formation of a glassy deposit. Secondarily, the accumulated glass deposit cools from the application temperature (temperature of the spray as it is deposited) down to room temperature. However, the deposition rates may often be anywhere from one to several tons per hour causing the glass deposit to build up very rapidly. The secondary cooling of the deposit down to room temperature is much slower than the cooling of the atomized spray, typically in the range of 50 to 200 K/s. Such a rapid build up of heated material in combination with the relatively slow cooling rate may cause the temperature of the deposit to increase, as the thermal mass increases. If the alloy is cooled below the glass transition temperature before crystallization is initiated, then the subsequent secondary slow cooling will not affect the glass content. However, often the deposit can heat up to 600 to 700° C. and at such temperatures, the glass may begin to crystallize. Thus, this crystallization can be avoided if the stability of the glass (i.e. the crystallization temperature) is increased.

There are many important parameters used to determine or predict the ability of an alloy to form a metallic glass, including the reduced glass or reduced crystallization temperature, the presence of a deep eutectic, a negative heat of mixing, atomic diameter ratios, and relative ratios of alloying elements. However, one parameter that has been very successful in predicting glass forming ability is the reduced glass temperature, which is the ratio of the glass transition temperature to the melting temperature. The use of reduced glass temperature as a tool for predicting glass forming ability has been widely supported by experimentation.

When dealing with alloys in which the glass crystallizes during heating before the glass transition temperature is reached, the reduced crystallization temperature, i.e., the ratio of the crystallization temperature to the melting temperature, can be utilized as an important benchmark. A higher reduced glass transition or reduced glass crystallization temperature indicates a decrease in the critical cooling rate necessary for the formation of metallic glass. As the critical cooling rate is reduced the metallic glass melt can be processed by a larger number of standard industrial processing techniques, thereby greatly enhancing the functionality of the metallic glass.

SUMMARY

A method for increasing the crystallization temperature of an iron based glass alloy comprising supplying an iron based glass alloy wherein said alloy has a melting temperature and crystallization temperature, adding to said iron based glass alloy lanthanide element; and increasing said crystallization temperature by addition of said lanthanide element.

BRIEF DESCRIPTION OF THE DRAWINGS

The various aspects and advantages of the present invention are described in part with reference to exemplary embodiments, which description should be understood in conjunction with the accompanying figures wherein:

FIG. 1 is a differential thermal analysis plot showing the glass to crystalline transition for ALLOY A alloy and gadolinium modified ALLOY A alloy; and FIG. 2 is a differential thermal analysis plot showing the glass to crystalline transition for ALLOY B alloy and gadolinium modified ALLOY B alloy.

DESCRIPTION OF THE PREFERRED EMBODIMENTS OF THE INVENTION

This invention is directed at the incorporation of lanthanide additions, such as gadolinium, into iron based alloys, thereby facilitating the ability of the alloy composition to form a metallic glass. Specifically, the amorphous glass state may be developed at lower critical cooling rates, with an increase in the crystallization temperature of the composition.

The present invention ultimately is an alloy design approach that may be utilized to modify and improve existing iron based glasses. Specifically, the property modification is related to two distinct properties. First, the present invention may allow the increase in the stability of the glass which results in increased crystallization temperature. Second, consistent with the present invention, the reduced crystallization temperature, i.e., the ratio of $T_{crystallization}/T_{melting}$, may be increased leading to a reduced critical cooling rate for metallic glass formation. The combined characteristics of the invention may lead to increases in the glass forming ability of an existing melt and stabilization of the glass which is created. This combined effect may enable technological exploitation of iron based metallic glasses by making the iron glass susceptible to a wide variety of processing approaches and many different kinds of applications.

The alloys for producing iron based glasses incorporate lanthanide additions, which are the elements of atomic number 58-71, namely cerium, praseodymium, neodymium, promethium, samarium, europium, gadolinium, terbium, dysprosium, holmium, erbium, thulium, ytterbium, and lutetium, although lanthanum (atomic number 57) may also be included in the lanthanide series. The incorporation of the lanthanide additions modify the physical properties of the glass, including increasing the crystallization temperature and increasing the reduced crystallization temperature. This approach can be applied generally to any existing iron based metallic glass. Preferably the lanthanide additions are combined at levels in the range of 0.10 atomic % to 50.0 atomic %, and more preferably at levels in the range of 1.0 atomic % to 10.0 atomic %, including all 0.1 atomic % intervals therebetween.

The iron alloys modified by gadolinium additions may be susceptible to many processing methods which cannot currently successfully produce metallic glass deposits, including weld on hard facing, spray forming, spray rolling, die-casting, and float glass processing. It should be noted, however, that each particular process will have an average cooling rate, making it important to design an alloy such that the critical cooling rate for glass formation of the alloy is less than the average cooling rate achieved in a particular processing method. Achieving a critical cooling rate that is less than the process cooling rate will allow glass to be formed by the particular processing technique.

WORKING EXAMPLES

Two metal alloys consistent with the present invention were prepared by making Gd additions at a content of 8 at % relative to the alloy to two different alloys, ALLOY A and ALLOY B. The composition of these alloys is given in Table 1, below. The resultant Gd modified alloys are, herein, respectively referred to as Gd modified ALLOY A and Gd modified ALLOY B, the compositions of which are also detailed in Table 1.

TABLE 1

Composition of Alloys

| Alloy | Composition |
|---|---|
| Alloy A | $(Fe_{0.8}Cr_{0.2})_{73}Mo_2W_2B_{16}C_4Si_1Mn_2$ |
| Gd Modified Alloy A | $[(Fe_{0.8}Cr_{0.2})_{73}Mo_2W_2B_{16}C_4Si_1Mn_2]_{92}Gd_8$ |
| Alloy B | $Fe_{54.5}Cr_{15}Mn_2Mo_2W_{1.5}B_{16}C_4Si_5$ |
| Gd Modified Alloy B | $(Fe_{54.5}Cr_{15}Mn_2Mo_2W_{1.5}B_{16}C_4Si_5)_{92}Gd_8$ |

The Gd modified alloys ALLOY A and Gd modified ALLOY B were compared to samples of the unmodified alloys, ALLOY A and ALLOY B using differential thermal analysis (DTA). Referring to FIGS. 1 and 2, the DTA plots indicate that, in both cases, the Gd modified ALLOY A and Gd modified ALLOY B alloys exhibit an increase in the crystallization temperature relative to the unmodified alloys ALLOY A and Dar 35. In the case of the Gd modified ALLOY B alloy compared to the ALLOY B alloy, illustrated in FIG. 2, the crystallization temperature is raised over 100° C. It is also noted that no previous iron alloy has been shown to have a crystallization temperature over 700° C. The crystallization onset temperatures for all of the exemplary alloys are given in Table 2.

TABLE 2

Thermal Analysis Results

| Alloy | Crystallization Onset Temperature (° C.) | Melting Temperature (° C.) |
|---|---|---|
| Alloy A | 580 | 1143 |
| Gd Modified Alloy A | 690 | 1140 |
| Alloy B | 613 | 1091 |
| Gd Modified Alloy B | 705, 720 | 1170 |

While not illustrated in the figures, the results of the DTA analysis indicate that the Gd additions resulted in little change in melting temperature of the modified alloys relative to the unmodified alloys. The melting temperatures for all of the exemplary alloys are also given in Table 2. Since the crystallization temperature of the alloys is raised but the melting temperature is largely unchanged, the result is an increase in the reduced crystallization temperature ($T_{crystallization}/T_{melting}$). The Gd addition to the alloy increased the reduced crystallization temperature from 0.5 to 0.61 for the ALLOY A series alloys (unmodified alloy to Gd modified alloy) and from 0.56 to 0.61 in the ALLOY B series alloys (unmodified alloy to Gd modified alloy).

What is claimed is:

1. A method for increasing a crystallization onset temperature of an iron based alloy comprising:

supplying an iron based alloy comprising 30–90 atomic percent iron with Cr, Mo, W, B, C, Si and Mn, said alloy having a crystallization temperature less than 675° C. and a reduced crystallization temperature, wherein said reduced crystallization temperature is the ratio of the crystallization temperature to the melting temperature;

adding to said iron based alloy a lanthanide element;

increasing said crystallization onset temperature above 675° C. by the addition of said lanthanide element and increasing said reduced crystallization temperature up to approximately 22%.

2. The method of claim 1 wherein said melting temperature of said iron based glass alloy prior to addition of said lanthanide element is substantially the same as to the melting point of the alloy subsequent to addition of said lanthanide element.

3. The method of claim 1 wherein the concentration of said lanthanide element added to said iron based glass alloy is in the range of 0.10 atomic % to 50.0 atomic %.

4. The method of claim 1 wherein the concentration of said lanthanide element added to said iron based glass alloy is in the range of 1.0 atomic % to 10.0 atomic %.

5. The method of claim 1 wherein said lanthanide element is selected from the Lanthanide series consisting of cerium, praseodymium, neodymium, promethium, samarium, europium, gadolinium, terbium, dysprosium, holmium, erbium, thulium, ytterbium, lutetium, lanthanum, and mixtures thereof.

* * * * *